US005493084A

United States Patent [19]

Whitaker et al.

[11] Patent Number: 5,493,084

[45] Date of Patent: Feb. 20, 1996

[54] DOOR RELEASE FOR CIRCUIT INTERRUPTER ROTARY HANDLE MECHANISM

[75] Inventors: Thomas A. Whitaker, North Huntingdon; Roger W. Helms, Beaver Falls; David C. Turner, Imperial; Thomas T. Kuzniarski, Coraopolis, all of Pa.

[73] Assignee: Eaton Corporation, Cleveland, Ohio

[21] Appl. No.: 286,057

[22] Filed: Aug. 4, 1994

[51] Int. Cl.$^6$ ..... H01H 9/20

[52] U.S. Cl. ..... 200/50 A; 200/330

[58] Field of Search ..... 200/50 R, 50 A, 200/318–327, 329, 330–332.2, 335–337, 339

[56] References Cited

U.S. PATENT DOCUMENTS

| | | | |
|---|---|---|---|
| 2,512,505 | 6/1950 | Rowe | 200/50 A |
| 2,695,934 | 11/1954 | Wills | 200/50 A |
| 2,894,084 | 7/1959 | Rexroad | 200/50 A |
| 2,961,501 | 11/1960 | Piteo, Jr. | 200/50 A |
| 3,009,029 | 11/1961 | Bodenschatz et al. | 200/50 A |
| 3,313,896 | 4/1967 | Gray | 200/50 A |
| 3,911,235 | 10/1975 | Venzke et al. | 200/50 A |
| 4,489,295 | 12/1984 | Altenhof, Jr. et al. | 335/20 |
| 4,612,424 | 9/1986 | Clark et al. | 200/50 A |
| 4,638,277 | 1/1987 | Thomas et al. | 335/190 |
| 4,656,444 | 4/1987 | McKee et al. | 335/16 |
| 4,679,018 | 7/1987 | McKee et al. | 335/167 |

OTHER PUBLICATIONS

Instructions for Drilling and Assembling Series C Rotary Handle Mechanism for K–Frame Series C Circuit Breakers, Molded Case Switches, and HMCPs, pp. 1–4, Nov. 1993, Westinghouse Electric Corporation I.L. 15600–A, File 29–000.

*Primary Examiner*—J. R. Scott
*Attorney, Agent, or Firm*—Martin J. Moran

[57] ABSTRACT

An operating mechanism for an enclosure-mounted circuit breaker includes a slider for engaging the circuit breaker handle; a shaft-driven pivot for moving the slider between the handle on, off and reset positions; a holder for holding the slider in its reset position; a base plate for supporting the pivot and the slider; and a door-mounted rotary handle for rotating the shaft and operating the pivot. The rotary handle may engage the shaft in the on and off positions, and may be detached from the shaft in the reset position. The pivot may include a first pivot arm having a first cam surface for holding the slider in its reset position. A second cam surface on a second pivot arm may engage a first slider surface from off to on; a second slider surface from on to off, from off toward reset, and to resist reset to off; and an oblique slider surface when adjacent reset. The second cam surface may disengage the oblique surface at reset. Alternatively, the slider may include a notch and the base plate may include a latch for engaging the notch. The pivot may include a single pivot arm having a cam surface which engages a slider surface from off to on; an oblique slider surface from on to off, and from off to reset in order to engage the notch and the latch; and another oblique surface to disengage the notch and the latch from reset to off. The slider may include an oblique shoulder for moving the handle from on to off and from off to reset, for resisting the handle force from reset to off, and for using the handle force to engage the notch and the latch in the reset position in order to substantially decouple the handle force from the rotary handle.

12 Claims, 5 Drawing Sheets

DOOR RELEASE FOR CIRCUIT INTERRUPTER ROTARY HANDLE MECHANISM

BACKGROUND OF THE INVENTION

1. Field of the Invention

This invention is directed to a rotary handle mechanism for a circuit interrupting device, and more particularly to a door release for such a mechanism used with a circuit breaker mounted in an enclosure.

2. Background of the Invention

Circuit interrupters (e.g., circuit switching devices, circuit breakers, etc.) are generally old and well-known in the art. Examples of circuit breakers are disclosed in U.S. Pat. No 4,489,295; 4,638,277; 4,656,444 and 4,679,018. Such circuit breakers are used to protect electrical circuitry from damage due to an overcurrent condition, such as an overload and relatively high level short circuit condition. Molded case circuit breakers, for example, include at least one pair of separable contacts which may be operated either manually by way of a handle disposed on the outside of the case or automatically in response to an overcurrent condition.

A common type of circuit switching device has a front face with a manual handle which may be arcuately operated between an on position and an off position. A common type of circuit breaker has a similar handle which is connected to movable contacts through a spring powered, over center toggle device which trips the contacts open and moves the handle to an intermediate trip position in response to certain overcurrent conditions. A fourth, reset position, which is beyond the off position and opposite from the on position, is used to reset a trip mechanism of the circuit breaker following a trip condition.

For a variety of reasons, such as operator safety, circuit interrupters are commonly mounted behind a panel or behind a door in a cabinet. Typically in these installations, the circuit interrupter handles are not directly accessible by the operator. In some of these installations, where the circuit interrupter handle is not located directly behind the panel or door, a remote handle mechanism drives one end of a flexible shaft in a linear push-pull manner. A rod at the other end of the flexible shaft is used to drive a sliding operating mechanism in a similar linear push-pull fashion. The sliding operating mechanism is mounted on the front face of the circuit interrupter and has a hole for inserting the circuit interrupter handle therethrough. The linear motion of the sliding operating mechanism is used to simulate the arcuate motion of the circuit interrupter handle.

In other such installations, where the circuit interrupter is installed inside an enclosure having a door and the circuit interrupter handle is suitably located behind the door, an external mechanism including a rotary handle is mounted to the opposite side of the door. A mechanical linkage, such as a rigid shaft, is used to interconnect the rotary handle with a pivot mechanism inside the enclosure. The pivot mechanism drives a sliding mechanism which moves the circuit interrupter handle between the on, off and reset positions.

During maintenance of such circuit interrupters, the enclosure door is opened by moving the rotary handle to its reset position. In the reset position, a latch in the rotary handle disengages the shaft and, hence, the door may be opened. For relatively large circuit interrupters, the reset operation, for example, may require between about 65 and 160 pounds of force. Such force is transmitted through the rotary handle to the shaft and, in turn, to the circuit interrupter handle. The resulting torque causes friction between the rotary handle and the shaft. Accordingly, the enclosure door is difficult to open.

There is a need, therefore, for a remote operating mechanism for an enclosure-mounted circuit interrupter which permits an enclosure door to freely open in the reset position of the circuit interrupter.

SUMMARY OF THE INVENTION

This and other needs are satisfied by the invention which is directed to an operating mechanism for a circuit interrupter mounted in an enclosure. The circuit interrupter has a handle which moves between on, off and reset positions. The circuit interrupter resists movement of the handle from the off to the reset position. The operating mechanism may include an engaging mechanism for engaging the handle; a moving mechanism for moving the engaging mechanism between positions which correspond to the handle on, off and reset positions; a holding mechanism for holding the engaging mechanism in the position corresponding to the handle reset position; a base plate for supporting the moving and engaging mechanisms; and an operating device mounted to the door of the enclosure for operating the moving mechanism in order to move the engaging mechanism between its on, off and reset positions. The operating device may be connected to the moving mechanism in the handle on and off positions, and may be detached from the moving mechanism in the handle reset position.

The engaging mechanism may be a slider which includes a first shoulder for moving the handle from off to on, and a second shoulder for moving the handle from on to off and from off to reset, or for resisting the handle force from reset to off. The slider may be slidably supported by the base plate in order to slide in a path which is generally tangential to a generally arcuate path of the handle. The moving mechanism may include a pivot mechanism including a pivot point, a first pivot arm for holding the slider, and a second pivot arm for moving the slider. The moving mechanism may also include a shaft for turning the pivot mechanism about the pivot point.

The holding mechanism may be a cam surface on the first pivot arm. The slider may include a holding surface which cooperates with this cam surface to hold the slider, with respect to the pivot point, in the slider reset position. The slider may include an opening which is formed between a first and a second surface. The opening may include a third surface which is generally oblique with respect to the first and second surfaces. The second pivot arm may have a cam surface for engaging the first surface of the slider and moving the slider from its off to its on position. The cam surface of the second pivot arm may also engage the second surface of the slider in order to move the slider from its on to its off position. The cam surface of the second pivot arm may further engage the second surface of the slider whenever the slider is between its off position and a position which corresponds to the handle being adjacent the reset position, and may at least momentarily engage the third surface of the slider when moving the slider toward the position which corresponds to the handle reset position. The cam surface of the first pivot arm may hold the slider by the holding surface before the cam surface of the second pivot arm disengages the third surface of the slider whenever the slider is substantially at its reset position. The cam surface of the second pivot arm may also engage the second surface of the slider in order to resist the handle force applied to the slider from its reset to its off position.

Alternatively, the operating mechanism may include an engaging mechanism including a holding mechanism for holding the engaging mechanism in the position which corresponds to the handle reset position; a moving mechanism for moving the engaging mechanism between the positions which correspond to the handle on, off and reset positions; a base plate for supporting the moving and engaging mechanisms; and an operating device mounted to the door of the enclosure for operating the moving mechanism in order to move the engaging mechanism between its on, off and reset positions.

The engaging mechanism may be a slider which includes a notch. The base plate may include a latch for engaging the notch in the reset position of the slider. The slider may include an opening which is formed between three surfaces of the slider. The moving mechanism may include a pivot arm having a cam surface which engages a first surface of the slider in order to move the slider from its off position to its on position. The cam surface of the pivot arm may move the slider by the second surface in order to disengage the notch and the latch before the slider moves from its reset to its off position. The cam surface may also engage a third surface of the slider in order to move the slider from on to off and from off to reset, or for resisting the handle force from reset to off.

The first surface of the slider may be generally perpendicular to the path of the engaging mechanism. The second and third surfaces may be generally oblique with respect to the first surface of the slider. The third surface of the slider, in response to the cam surface of the pivot arm, may move the slider in order to engage the notch and the latch whenever the slider moves from its off to its reset position.

The slider may also include a first shoulder for moving the handle from the off to the on position. The first shoulder may be generally parallel with the first surface of the slider. The slider may further include a second shoulder for moving the handle from on to off and from off to reset, or for resisting the handle force from reset to off. The second shoulder may be at least partially oblique with respect to the first surface of the slider in order that the reset handle force on the second shoulder forces the notch of the slider to continue to engage the latch thereby substantially decoupling the handle force from the moving mechanism to the latch.

The operating device may include a rotary handle operator which is mounted to the enclosure door for turning the shaft in order to engage the moving mechanism. The rotary handle operator may include a slot for engaging and disengaging the shaft. The rotary handle operator may also include a latch for latching the shaft whenever the handle is in the on and off positions, and for unlatching the shaft in the handle reset position in order that the enclosure door may be opened. In the handle reset position, the handle reset force is substantially decoupled by the holding mechanism from the moving mechanism and the shaft, thereby allowing the slot of the rotary handle operator to freely disengage the shaft in order to open the enclosure door.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
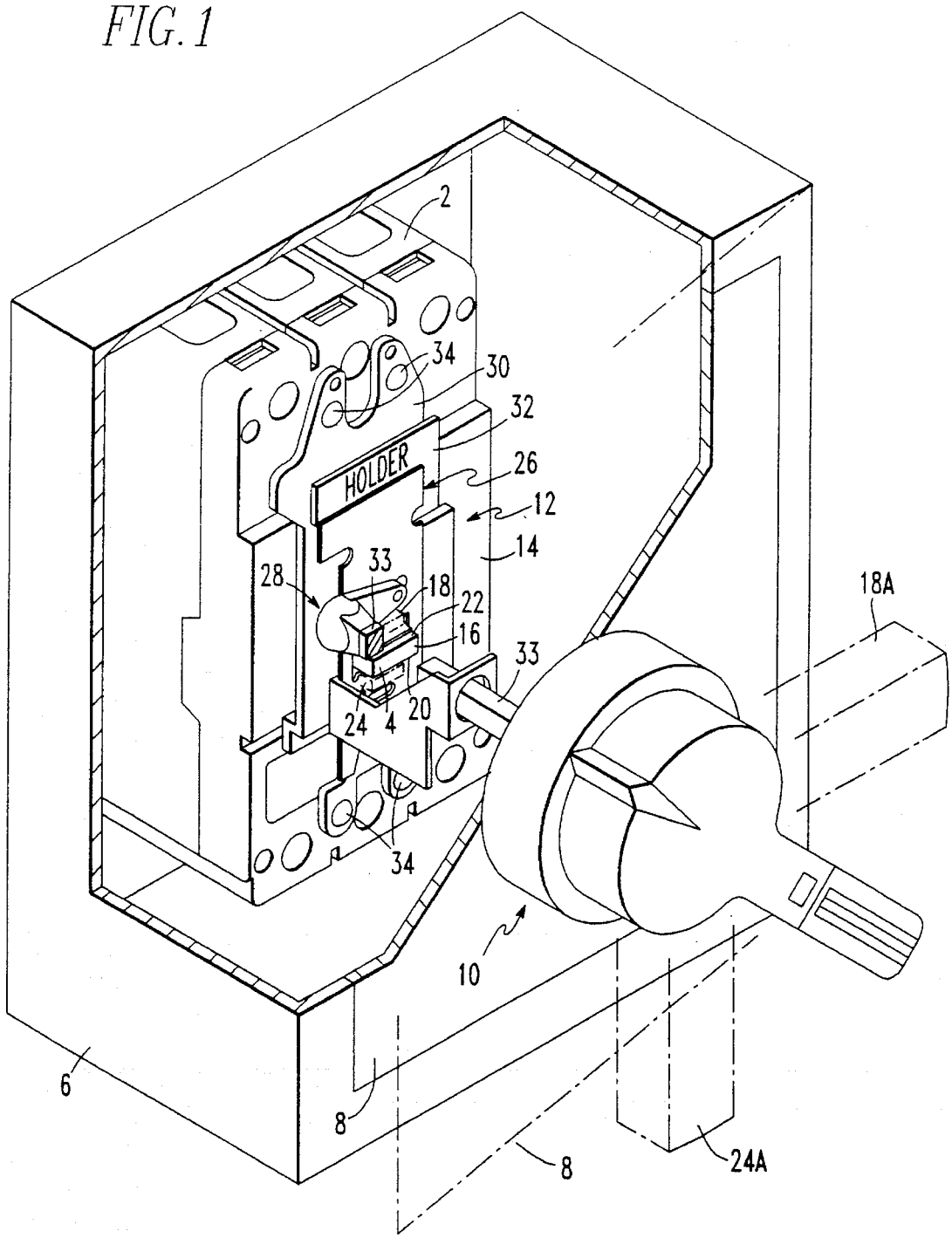
FIG. 1 is a cut-away isometric view of an enclosure having a door, a circuit breaker mounted in the enclosure, and a rotary handle mounted to the door in accordance with the invention.

Referring to FIG. 1, a circuit breaker 2 having a handle 4 is mounted within an enclosure 6. The enclosure 6 includes a door 8 which is shown in a closed position. The door 8 has a rotary handle operator 10 mounted thereto. An operating mechanism 12 including the rotary handle operator 10 interfaces the handle 4 of the circuit breaker 2. The handle 4, which is positioned on a front face 14 of the circuit breaker 2, arcuately moves between an off position 16 (shown in FIG. 1 ) and an on position 18 (shown in shadow above the off position). The handle 4 has a lower surface 20 for moving the handle 4 toward the on position 18 and an opposite upper surface 22 for moving the handle 4 toward the off position 16. The upper surface 22 may also be used for moving the handle 4 toward a reset position 24 (shown in shadow below the off position), it being understood that the invention is applicable to other types of circuit interrupters having additional handle positions (e.g., a trip position). As will be explained in greater detail below, the door 8 of the enclosure 6 may be opened (as shown in shadow) whenever the handle 4 of the circuit breaker 2 is in the reset position 24. The on position 18 and the reset position 24 of the handle 4 correspond to the positions 18A and 24A (shown in shadow), respectively, of the rotary handle operator 10.

The operating mechanism 12 also includes an engaging mechanism 26 for engaging the handle 4 of the circuit breaker 2. The operating mechanism further includes a moving mechanism 28, a base plate 30 and a holder 32. The moving mechanism 28 including a shaft 33 moves the engaging mechanism 26 between positions which correspond to the on position 18, the off position 16 and the reset position 24 of the handle 4 of the circuit breaker 2. The base plate 30 is fixedly attached to the front face 14 of the circuit breaker 2 by four fasteners 34. As will be described in greater detail below with FIG. 2, the base plate 30 pivotally supports the moving mechanism 28 and slidably supports the engaging mechanism 26 which slides in a path which is generally tangential to the generally arcuate path of the handle 4 of the circuit breaker 2. Furthermore, the holder 32 holds the engaging mechanism 26 in a position which corresponds to the reset position 24 of the handle 4 of the circuit breaker 2.

As will be described in greater detail below with FIG. 5, the rotary handle operator 10 is mounted to the door 8 of the enclosure 6 and operates the shaft 33 of the moving mechanism 28. The rotary handle operator 10 is connected to the shaft 33 in the on position 18 and the off position 16 of the handle 4. The rotary handle operator 10 may be detached from the shaft 33 in the reset position 24. In the exemplary embodiment, the operating force required to move the handle 4 from the off position 16 to the reset position 24 is approximately 160 pounds, it being understood that the present invention is applicable to a wide variety of handle reset forces.

Figure 2:
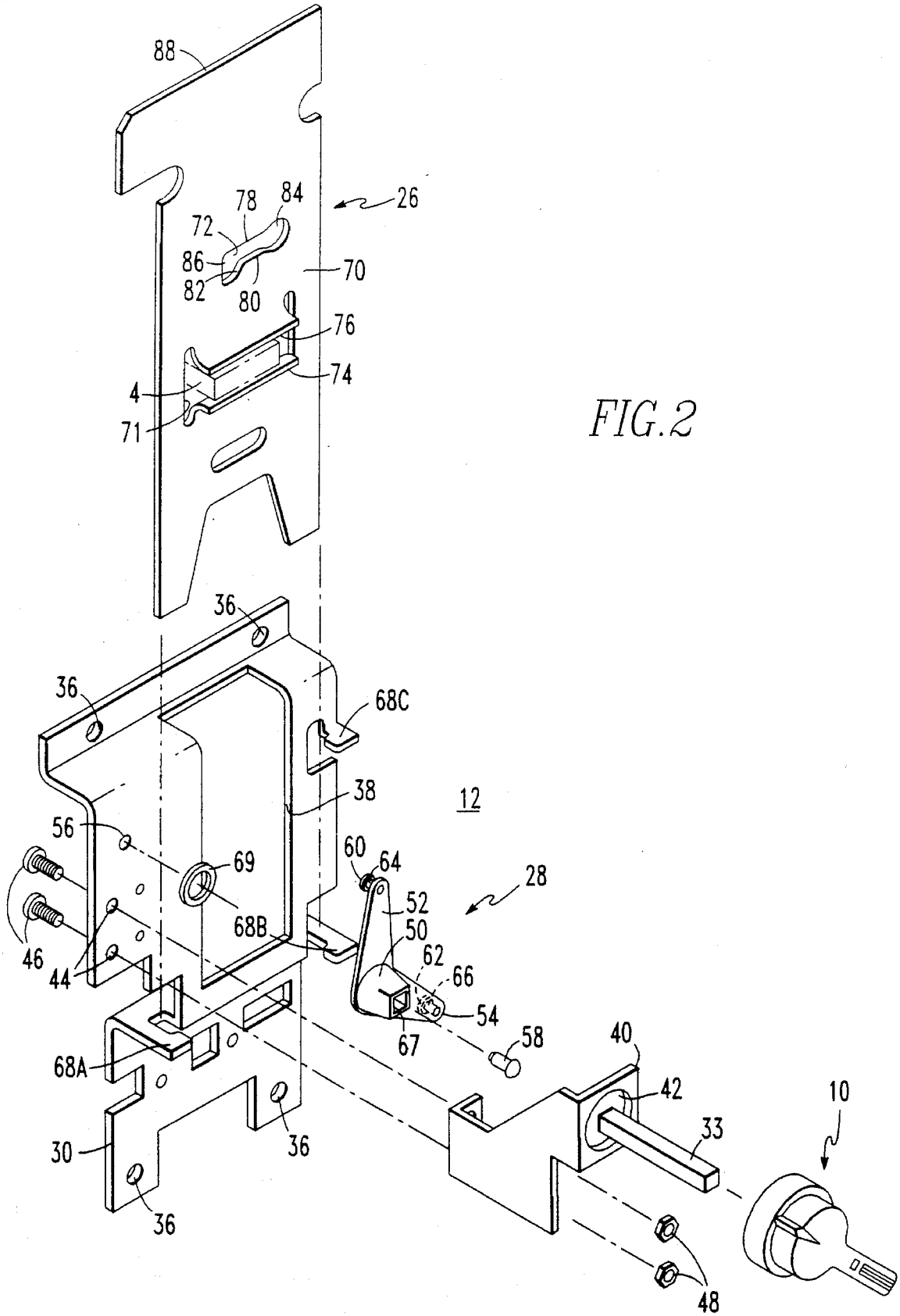
FIG. 2 is an exploded isometric view of an operating mechanism for a circuit breaker in accordance with an embodiment of the invention.

Referring now to FIG. 2, an exploded isometric view of the operating mechanism 12 is illustrated. The base plate 30 includes four mounting holes 36 for the four fasteners 34 of FIG. 1. The handle 4 (shown in shadow) passes through a generally rectangular hole 38 in the center of the base plate 30. A support 40 having a hole 42 for guiding the shaft 33 is attached to two holes 44 in the base plate 30 by two screws 46 and two hex nuts 48. A pivot 50 having two pivot arms 52,54 is pivotally mounted to a hole 56 in the base plate 30 by a pivot pin 58. Two inserts 60,62 including cam surfaces 64,66 are fixedly attached to the ends of the pivot arms 52,54, respectively.

The operation of these cam surfaces 64,66 is discussed in greater detail below with FIG. 3. Briefly, the first pivot arm 52 and cam surface 64 are used for holding the engaging mechanism 26. The second pivot arm 54 and cam surface 66 are used for moving the engaging mechanism 26. The shaft 33 passes through the hole 42 of the support 40 and is secured within the square opening 67 of the pivot 50. The base plate 30 also includes four guides 68A,68B,68C,69 which slidably guide and retain the engaging mechanism 26 above the base plate 30. The exemplary guide 69 is a spacer (e.g., a washer) which is mounted at the hole 56 beneath the pivot 50. Those skilled in the art will appreciate that a suitable lubricant, such as moly grease (not shown), may be used to lubricate the sides of the engaging mechanism 26 and the four guides 68A,68B,68C,69.

Figure 3:
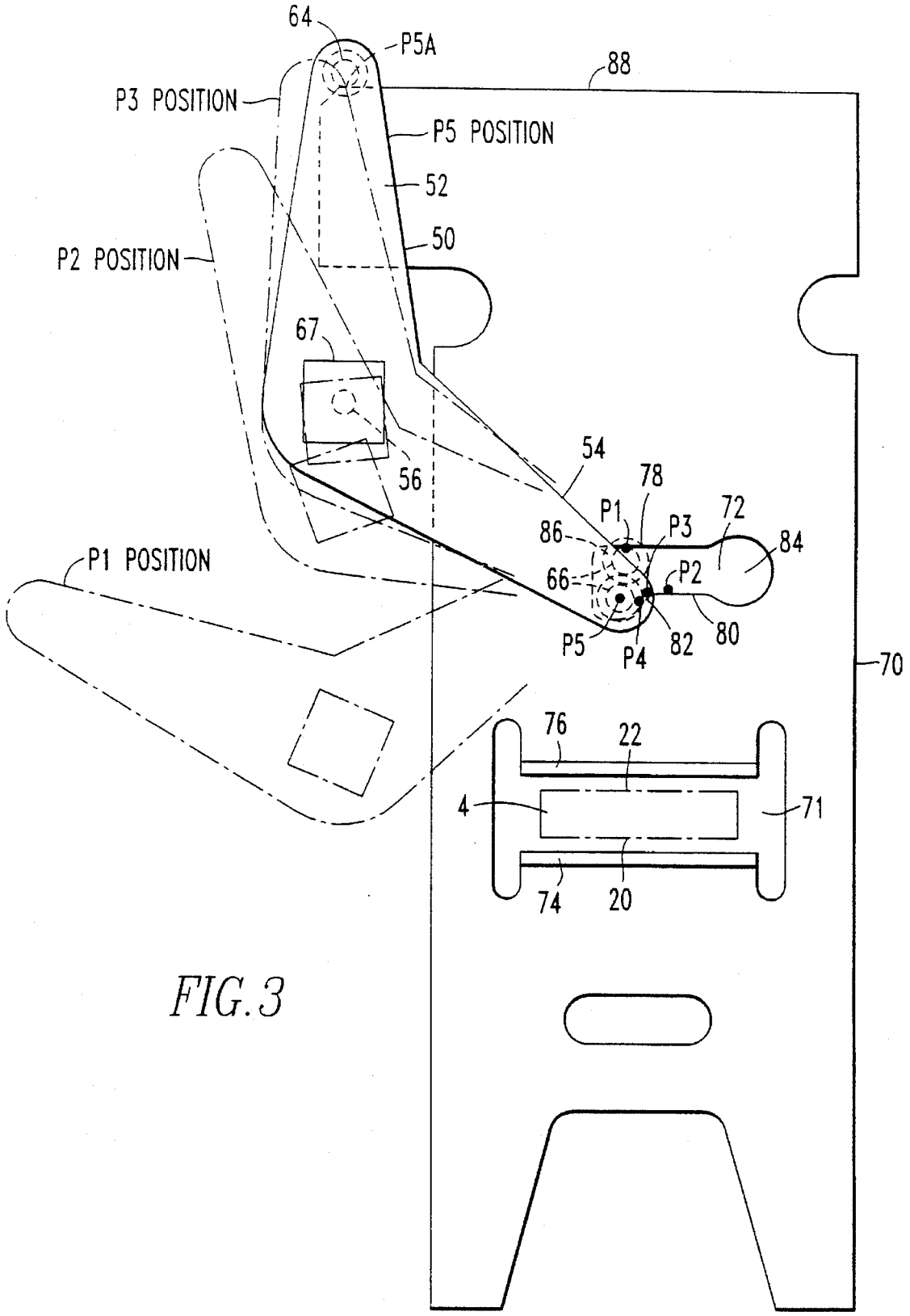
FIG. 3 is a top view of a slider and a pivot having two cam surfaces for moving and holding the slider: in accordance with the embodiment of FIG. 2.

Referring to FIGS. 1 and 2 and FIG. 3, which shows a top view of a slider 70 and the pivot 50, the slider 70 includes a first opening 71 for the handle 4 (shown in shadow in FIG. 3) and a second opening 72 for the cam surface 66 (shown in shadow in FIG. 3). The exemplary first opening 71 has an H-shape. Two shoulders 74,76 are formed parallel to the cross-bar of the H-shaped opening 71. The first shoulder 74 is adjacent the lower surface 20 of the handle 4. The second shoulder 76 is adjacent the upper surface 22 of the handle 4. The first shoulder 74 is used for moving the handle 4 from the off position 16 to the on position 18. In a related manner, the second shoulder 76 is used for moving the handle 4 from the on position 18 to the off position 16 and from the off position 16 to the reset position 24. The second shoulder 76 also resists the handle force from the reset position 24 to the off position 16 of the handle 4.

As best illustrated by FIG. 3, the exemplary second opening 72 of the slider 70 has a key-hole shape which includes an upper horizontal surface 78, a lower horizontal surface 80, and an oblique cam surface 82 adjacent the lower horizontal surface 80. A generally circular cut-out 84 abuts the surfaces 78,80 and a generally rectangular cut-out 86 abuts the surfaces 78,82.

Continuing to refer to FIGS. 1–3, the cam surface 66 of the second pivot arm 54 engages the upper surface 78 of the slider 70 (as shown in shadow at about point P1) in order to move the slider 70 in an upward direction with respect to FIG. 3. By turning the rotary handle operator 10 counter-clockwise, the shaft 33 and the pivot 50 rotate in a like direction. In turn, the second pivot arm 54 (as shown in shadow in the P 1 POSITION of FIG. 3) moves the cam surface 66 which drives the upper surface 78 of the slider 70. The slider 70, then, moves the first shoulder 74 which drives the lower surface 20 of the handle 4. In this manner, the operating mechanism 12 operates the slider 70 upward from the position which corresponds to the off position 16 to the position which corresponds to the on position 18 of the handle 4.

The cam surface 66 of the second pivot arm 54 engages the lower surface 80 of the slider 70 (as shown in shadow between points P2 and P3) in order to move the slider 70 in an downward direction with respect to FIG. 3. By turning the rotary handle operator 10 clockwise, the shaft 33 and the pivot 50 rotate in a like direction. In turn, the second pivot arm 54 (as shown in shadow between the P2 POSITION and the P3 POSITION of FIG. 3) moves the cam surface 66 which drives the lower surface 80 of the slider 70. The slider 70, then, moves the second shoulder 76 which drives the upper surface 22 of the handle 4. In this manner, the operating mechanism 12 operates the slider 70 downward from the position which corresponds to the on position 18 to the position which corresponds to the off position 16.

Continuing to refer to FIGS. 1–3, whenever the handle 4 is in the off position 16, the cam surface 66 of the second pivot arm 54 first engages the lower surface 80 of the slider 70 (as shown in shadow at about point P3) in order to move the slider 70 in a further downward direction with respect to FIG. 3. As the handle 4 approaches the reset position 24, the cam surface 66 of the second pivot arm 54 engages the oblique cam surface 82 of the slider 70 (as shown in shadow at about point P4) and continues to move the slider 70 in a still further downward direction with respect to FIG. 3. By continuing to turn the rotary handle operator 10 clockwise, the shaft 33 and the pivot 50 continue to rotate in a like direction. The second pivot arm 54 moves the cam surface 66 which continues to drive the oblique cam surface 82 of the slider 70. The slider 70 continues to move the second shoulder 76 and drive the upper surface 22 of the handle 4. In this manner, the operating mechanism 12 operates the slider 70 downward from the position which corresponds to the off position 16 toward the position which corresponds to the reset position 24.

The cam surface 66 continues to engage the oblique cam surface 82 until the handle 4 is adjacent the reset position 24. At this position, the cam surface 64 of the first pivot arm 52, which has also rotated in a clockwise direction with respect to FIG. 3, approaches and engages an upper surface of the slider 70 (as shown in shadow at point P5A) which forms a holding surface 88. Then, as shown in the P5 POSITION of FIG. 3, the cam surface 64 of the first pivot arm 52 holds the slider 70 by the holding surface 88 before the cam surface 66 of the second pivot arm 54 disengages the oblique cam surface 82 of the slider 70. After this operation, the insert 62 having the cam surface 66 moves to an idle point P5 within the cut-out 86. Preferably, the point P5A of the holding surface 88 is oriented, with respect to the pivot 50, such that the handle reset force provides no force to rotate the pivot 50 counter-clockwise and disengage the cam surface 64 from the holding surface 88. As shown in FIG. 3, the exemplary point P5A is directly above the pivot point (i.e., hole 56 of the base plate 30 of FIG. 1) of the pivot 50.

Preferably, the off to reset operation involves the cam surface 66 driving the lower surface 80 for most of such operation. Next, the cam surface 66 briefly drives the oblique cam surface 82. Finally, when the slider 70 is substantially at the position which corresponds to the reset position 24 of the handle 4, the cam surface 64 holds the holding surface 88, the cam surface 66 disengages the oblique cam surface 82, and the insert 62 is free within the generally rectangular cut-out 86. Thereafter, the cam surface 64 of the first pivot arm 52 holds the holding surface 88 in order to hold the slider 70 in the position which corresponds to the reset position 24. The cam surface 64, which is at the end of the first pivot arm 52, holds the holding surface 88 and the slider 70 with respect to the pivot hole 56, in the position which corresponds to the reset position 24. In this manner, as discussed in greater detail with FIG. 5 below, the handle reset force is substantially decoupled from the shaft 33 by the cam surface 64.

During the reset to off operation, the cam surface 64 of the first pivot arm 52 rotates in a counter-clockwise direction with respect to FIG. 3 and disengages the holding surface 88 of the slider 70. Subsequently, the handle reset force, as resisted by the slider 70 and the rotary handle operator 10, moves the slider 70 to the off position 16.

Figure 4A:
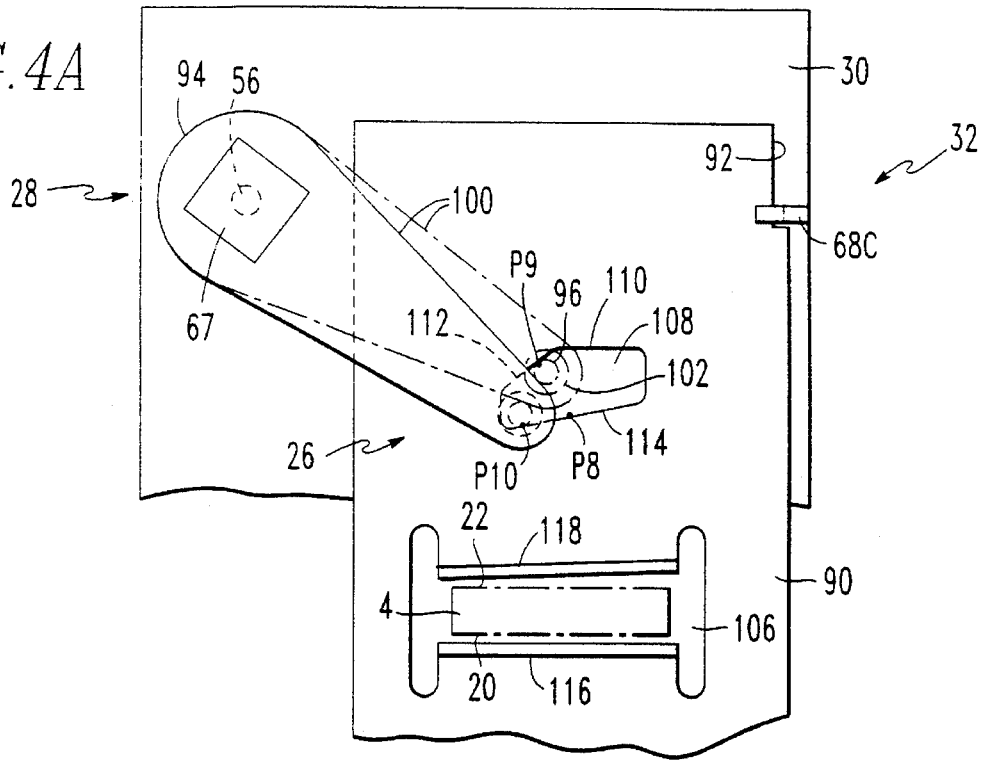
FIGS. 4A–4B are top views of a slider having a notch for holding the slider and a pivot having a cam surface for moving the slider in accordance with an alternative embodiment of the invention.
Figure 4B:
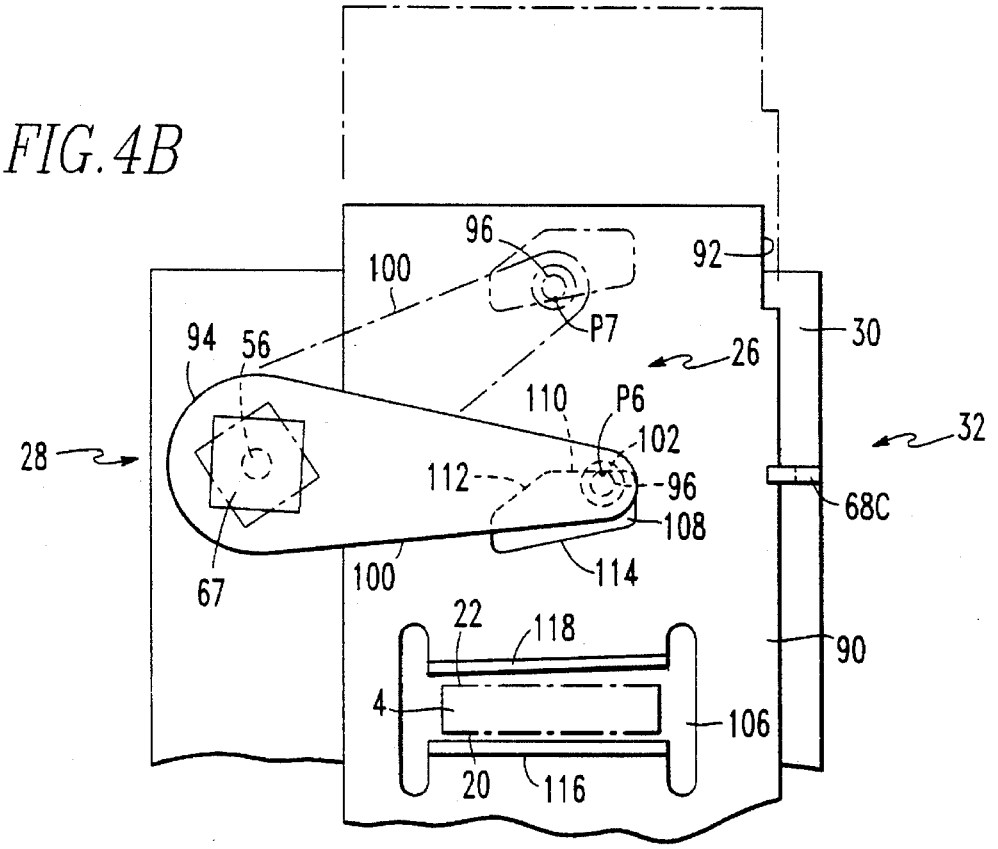

FIGS. 4A and 4B are top views of an alternative slider 90 having a notch 92 for holding the slider 90 and an alternative pivot 94 having a cam surface 96 for moving the slider 90. As will be explained in greater detail below, the notch 92 holds the slider 90 in the position which corresponds to the reset position 24 of the handle 4 of FIG. 1. As explained above with FIG. 1, the operating mechanism 12 includes the rotary handle operator 10, the engaging mechanism 26, the moving mechanism 28, the base plate 30 and the holder 32.

Continuing to refer to FIGS. 1 and 4A and 4B, the exemplary slider 90 is the engaging mechanism 26. The base plate 30 includes a latching guide 68C for engaging the notch 92 of the slider 90. The notch 92 and the latching guide 68C are the holder 32. The moving mechanism 28 includes the pivot 94 having a pivot arm 100 for moving the slider 90. Fastened to the end of the pivot arm 100 is an insert 102 including a cam surface 96.

As illustrated by FIGS. 4A and 4B, the slider 90 includes a first opening 106 for the handle 4 (shown in shadow) and a second opening 108 for the cam surface 96 (shown in shadow). The second opening 108 is formed between three surfaces 110,112,114 of the exemplary slider 90. Referring to FIGS. 1 and 4B, the cam surface 96 engages the first surface 110 of the slider 90 at about point P6 in order to move the slider 90 from the position which corresponds to the off position 16 to the position which corresponds to the on position 18 of the handle 4. The cam surface 96 engages the third surface 114 (as shown in shadow at about point P7) in order to move the slider 90 from the position which corresponds to the on position 18 to the position which corresponds to the off position 16, and (as shown in shadow at about point P8) in order to move the slider 90 from the position which corresponds to the off position 16 to the position which corresponds to the reset position 24, and, also, to resist the handle force from the position which corresponds to the reset position 24 to the position which corresponds to the off position 16 of the handle 4.

Referring to FIGS. 1 and 4A, the cam surface 96 engages the second surface 112 (as shown in shadow at about point P9) in order to disengage the notch 92 of the slider 90 from the latching guide 68C. Then, the handle reset force moves the handle 4 and the slider 90 from the position which corresponds to the reset position 24 to the position which corresponds to the off position 16. During this operation, the cam surface 96 engages the third surface 114 between about point P10 and point P8.

As shown in FIGS. 4A and 4B, the first surface 110 of the slider 90 is generally perpendicular to the longitudinal axis of the slider 90. Hence, the slider 90 slides in a path which is generally tangential to the generally arcuate path of the handle 4 of the circuit breaker 2 of FIG. 1. The second surface 112 and the third surface 114 are generally oblique with respect to the first surface 110 of the slider 90.

The generally oblique angle of the third surface 114 with respect the longitudinal axis of the slider 90, causes the cam surface 96 to move the slider 90 down and fight with respect to FIG. 4B whenever the slider 90 moves from the position which corresponds to the off position 16 to the position which corresponds to the reset position 24 of the handle 4 of FIG. 1. As explained in greater detail below, when the reset operation of the handle 4 is completed, the notch 92 engages the latching guide 68C as shown in FIG. 4A.

The generally oblique angle of the second surface 112 with respect the longitudinal axis of the slider 90, causes the cam surface 96 to move the slider 90 up and left with respect to FIG. 4A whenever the slider 90 moves from the position which corresponds to the reset position 24 to the position which corresponds to the off position 16 of the handle 4 of FIG. 1. This movement, which is up and left with respect to FIG. 4A, causes the notch 92 to disengage from the latching guide 68C.

Referring to FIGS. 1 and 4A and 4B, the exemplary first opening 106 of the slider 90 has a general H-shape. Two shoulders 116,118 are formed adjacent the cross-bar of the H-shaped opening 106. The first shoulder 116 is adjacent the lower surface 20 of the handle 4. The second shoulder 118 is generally adjacent the upper surface 22 of the handle 4. The first shoulder 116, which is parallel with the first surface 110 of the slider 90, is used for moving the handle 4 from the off position 16 to the on position 18. In a related manner, the second shoulder 118 is used for moving the handle 4 from the on position 18 to the off position 16 and from the off position 16 to the reset position 24, or for resisting the handle force from the reset position 24 to the off position 16.

The second shoulder 118 is at least partially oblique with respect to the first surface 110 of the slider 90. The exemplary second shoulder 118 is at an angle of 1.6 degrees with respect to the first shoulder 116. This exemplary angle coupled with the handle reset force partially forces the slider 90 clockwise with respect to FIG. 4A. Hence, the notch 92 of the slider 90 continues to engage the latching guide 68C whenever the slider 90 is in the position which corresponds to the reset position 24 of the handle 4. In this manner, the handle reset force is substantially decoupled from the shaft 33 by the latching guide 68C.

Figure 5:
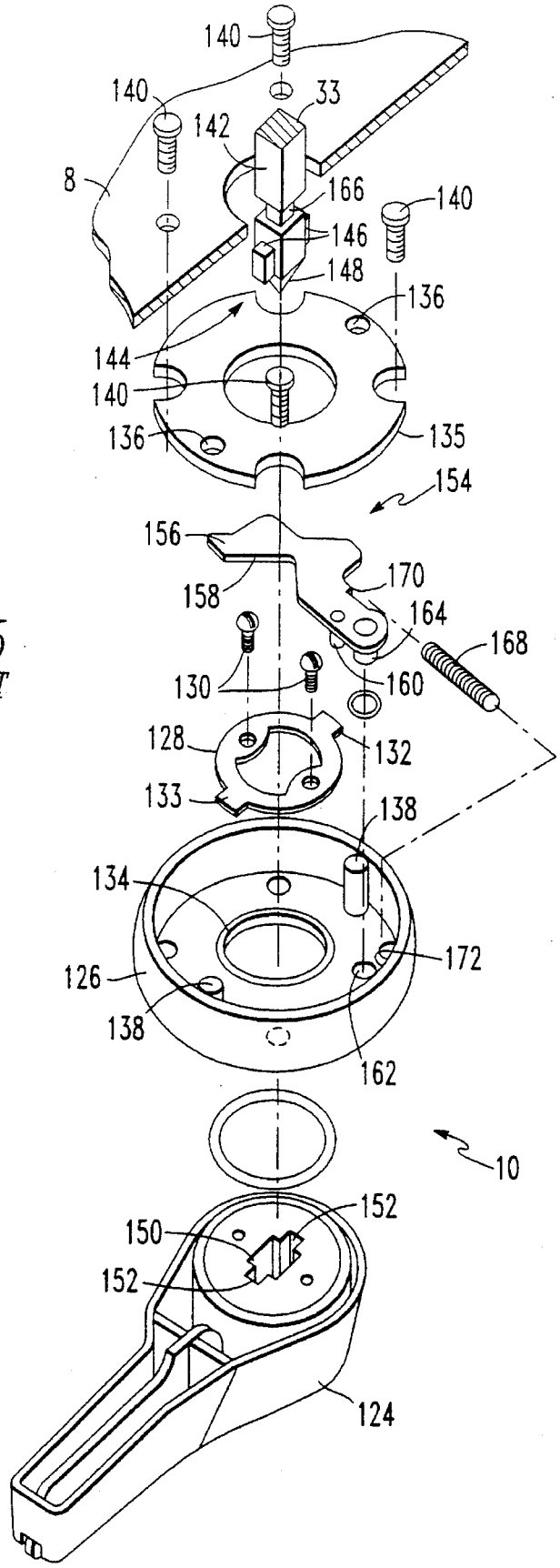
FIG. 5 PRIOR ART
FIG. 5 is an exploded isometric view of a rotary handle for latching a shaft.

Referring now to FIG. 5, an exploded isometric view of the rotary handle operator 10 is illustrated. The rotary handle operator 10 includes a rotary handle 124, a base 126 and a pivot plate 128. The pivot plate 128 is fastened to the rotary handle 124 by two fasteners 130. The pivot plate 128 includes two tabs 132,133 which pivotally abut a surface 134 of the base 126 and allow the rotary handle 124 to pivotally turn about the base 126. A mounting plate 135 includes two holes 136 which are aligned with two tabs 138 on the bottom of the base 126. The rotary handle operator 10 is mounted to the door 8 of the enclosure 6 of FIG. 1 by four fasteners 140.

The shaft 33 includes a square shaft portion 142 which engages the square opening 67 of the pivot 50 of FIG. 2 or the pivot 94 of FIGS. 4A–4B. The shaft 33 also includes a head portion 144 having two alignment tabs 146 and a pointed head 148. The rotary handle 124 has a hole 150 for accepting the head 148 of the shaft 33 and two alignment slots 152 for accepting the alignment tabs 146 of the shaft 33. Accordingly, whenever the door 8 of the enclosure 6 of FIG. 1 is closed, rotation of the rotary handle 124 turns the shaft 33 which engages the pivot 50 of FIG. 2 or the pivot 94 of FIGS. 4A–4B. The hole 150 and the slots 152 of the rotary handle 124 engage and disengage the head 148 and tabs 146, respectively, of the shaft 33.

Referring to FIGS. 1 and 5, the rotary handle operator 10 also has a latch 154 for latching the shaft 33 whenever the handle 4 of the circuit breaker 2 is in the on position 18 and in the off position 16. The latch 154 unlatches the shaft 33 whenever the handle 4 is in the reset position 24. As shown in FIG. 5, the latch 154 includes a pivot arm 156 having a latching surface 158 and an unlatching pin 160. The latch 154 is pivotally mounted to a pivot hole 162 in the base 126 by a pivot pin 164 at one end of the pivot arm 156. The other end of the pivot arm 156 includes the latching surface 158 for grasping a neck 166 of the shaft 33 in the on position 18 and in the off position 16.

The latch 154 also includes a compression spring 168 which is connected between a shoulder 170 of the pivot arm 156 and a surface 172 of the base 126. The compression spring 168 biases the latch 154 in a normally latched position. Whenever the rotary handle 124 is fully rotated clockwise with respect to FIG. 1 to the position 24A which corresponds to the reset position 24 of the handle 4 of the circuit breaker 2, the tab 133, after rotating counter-clockwise with respect to FIG. 5 and engaging the unlatching pin 160, rotates the pivot arm 156 clockwise with respect to FIG. 5 and further compresses the spring 168. In turn, the latching surface 158 moves away from and unlatches the neck 166 of the shaft 33.

Still referring to FIGS. 1 and 5, the handle reset force is decoupled from the shaft 33 by the cam surface 64 of FIGS. 2 and 3 or by the latching guide 68C of FIG. 4A, respectively. Furthermore, this force is also decoupled from the moving mechanism 28 by the holder 32. Accordingly, whenever the handle 4 is in the reset position 24, the hole 150 and slots 152 of the rotary handle operator 10 may freely disengage the shaft 33 in order to open the door 8 of the enclosure 6. In this manner, the door 8 may be freely opened whenever the handle 4 of the circuit breaker 2 is in the reset position 24.

In order to close the door 8 of the enclosure 6, the rotary handle 124 is positioned in its reset position before closing the door 8. This allows the hole 150 and the slots 152 of the rotary handle 124 to engage the head 148 and the tabs 146, respectively, of the shaft 33. Subsequently, when the rotary handle 124 is positioned in its off position as shown in FIG. 1, the latching surface 158 of the latch 154 engages the neck 166, and the rotary handle 124 rotates the shaft 33 counterclockwise with respect to FIG. 1. In the exemplary embodiment of FIGS. 2 and 3, this rotates the cam surface 64 of the first pivot arm 52 counterclockwise. Then, the cam surface 64 disengages the holding surface 88 of the slider 70 and the handle reset force, as resisted by the slider 70 at the second shoulder 76 and by the cam surface 66 at the lower surface 80 of the slider 70, moves the slider 70 in an upward direction with respect to FIG. 3 to the position corresponding to the off position 16.

In the alternative embodiment of FIGS. 4A and 4B, this counterclockwise movement of the rotary handle 124 also rotates the pivot 94 and the pivot arm 100 counterclockwise. In turn, the generally oblique angle of the second surface 112 of the slider 90 causes the cam surface 96 of the pivot arm 100 to move the slider 90 up and left with respect to FIG. 4A. This movement causes the notch 92 of the slider 90 to disengage from the latching guide 68C. Then, the handle reset force, as resisted by the slider 90 at the second shoulder 118 and by the cam surface 96 at the third surface 114 of the slider 70, moves the slider 70 in an upward direction with respect to FIG. 4A to the position corresponding to the off position 16.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed:

1. An operating mechanism for a circuit interrupter having a handle which moves between an on position and an off position, and between the off position and a reset position, said circuit interrupter having a handle force which resists movement of the handle from the off position to the reset position, said circuit interrupter mounted in an enclosure having a door, said operating mechanism comprising:

engaging means for engaging the handle of said circuit interrupter; moving means for moving said engaging means between positions which correspond to the on position, the off position and the reset position of the handle of said circuit interrupter;

holding means for holding said engaging means in the position which corresponds to the reset position of the handle of said circuit interrupter;

base plate means for supporting said moving means and said engaging means; and operating means mounted to the door of said enclosure for operating said moving means in order to move said engaging means between the positions which correspond to the on position, the off position and the reset position of the handle of said circuit interrupter, said operating means being connected to said moving means whenever the handle of said circuit interrupter is in the on position and the off position, and being detachable from said moving means whenever the handle of said circuit interrupter is in the reset position, said moving means including a pivot means having a pivot point, a first pivot arm and a second pivot arm, said holding means being mounted on the first pivot arm in order to hold said engaging memos, with respect to the pivot point, in the position which corresponds to the reset position of the handle of said circuit interrupter, the second pivot arm for moving said engaging means.

2. The operating mechanism as recited in claim 1 wherein said engaging means includes a holding surface, and wherein the first pivot arm includes a cam surface for holding the holding surface in order to hold said engaging means in the position which corresponds to the reset position of the handle of said circuit interrupter.

3. The operating mechanism as recited in claim 1 wherein said engaging means includes an opening which is formed between a first surface and a second surface of said engaging means; and wherein the second pivot arm includes a cam surface which engages the first surface of said engaging means in order to move said engaging means from the position which corresponds to the off position to the position which corresponds to the on position of the handle of said circuit interrupter, the cam surface of the second pivot arm also for engaging the second surface of said engaging means in order to move said engaging means from the position which corresponds to the on position to the position which corresponds to the off position of the handle of said circuit interrupter, and in order to resist the handle force applied to said engaging means from the position which corresponds to the reset position to the position which corresponds to the off position of the handle of said circuit interrupter.

4. The operating mechanism as recited in claim 3 wherein the opening of said engaging means also includes a third surface which is generally oblique with respect to the first surface and the second surface, and wherein the cam surface of the second pivot arm at least momentarily engages the second surface and the third surface of said engaging means when moving said engaging means from the position which corresponds to the off position toward the position which corresponds to the reset position of the handle of said circuit interrupter.

5. The operating mechanism as recited in claim 3 wherein the handle force of said circuit interrupter is substantially decoupled by said holding means from said moving means.

6. The operating mechanism as recited in claim 5 wherein the cam surface of the second pivot arm engages the second surface of said engaging means whenever said engaging means is between the position which corresponds to the off position and a position which corresponds to the handle of said circuit interrupter being adjacent the reset position, and wherein the cam surface of the first pivot arm holds said engaging means by the holding surface before the cam surface of the second pivot arm disengages the third surface of said engaging means whenever said engaging means is substantially at the position which corresponds to the reset position of the handle of said circuit interrupter.

7. An operating mechanism for a circuit interrupter having a handle which moves between an on position and an off position, and between the off position and a reset position, said circuit interrupter having a handle force which resists movement of the handle from the off position to the reset position, said circuit interrupter mounted in an enclosure having a door, said operating mechanism comprising:

engaging means for engaging the handle of said circuit interrupter;

moving means for moving said engaging means between positions which correspond to the on position the off position and the reset position of the handle of said circuit interrupter;

holding means for holding said engaging means in the position which corresponds to the reset position of the handle of said circuit interrupter;

base plate means for supporting said moving means and said engaging means; and operating means mounted to the door of said enclosure for operating said moving means in order to move said engaging means between the positions which correspond to the on position, the off position and the reset position of the handle of said circuit interrupter, said operating means being connected to said moving means whenever the handle of said circuit interrupter is in the on position and the off position, and being detachable from said moving means whenever the handle of said circuit interrupter is in the reset position, said moving means including a rotary handle operator means mounted to the door of said enclosure, said moving means including a shaft, the rotary handle operator means the turning the shaft in order to engage said moving means, said base plate means including shaft support means for supporting the shaft.

8. The operating mechanism as recited in claim 7 wherein the rotary handle operator means has a latch for latching the shaft, the latch latching the shaft whenever the handle of said circuit interrupter is in the on position and in the off position, and the latch unlatching the shaft whenever the handle of said circuit interrupter is in the reset position, in order that the door of said enclosure may be opened whenever the handle of said circuit interrupter is in the reset position.

9. The operating mechanism as recited in claim 8 wherein the rotary handle operator means includes a slot for engaging and disengaging the shaft; and wherein the handle force of said circuit interrupter is substantially decoupled by said holding means from said moving means and the shaft whenever the handle of said circuit interrupter is in the reset position, thereby allowing the slot of the rotary handle operator means to freely disengage the shaft in order to open the door of said enclosure in the reset position.

10. An operating mechanism for a circuit interrupter having a handle which moves between an on position and an off position, and between the off position and a reset position, said circuit interrupter having a handle force which resists movement of the handle from the off position to the reset position, said circuit interrupter mounted in an enclosure having a door, said operating mechanism comprising:

engaging means for engaging the handle of said circuit interrupter, said engaging means including holding means for holding said engaging means in a position which corresponds to the reset position of the handle of said circuit interrupter;

moving means for moving said engaging means between the position which corresponds to the reset position of the handle of said circuit interrupter and positions which correspond to the on position and the off position of the handle of said circuit interrupter;

base plate means for supporting said moving means and said engaging means; and operating means mounted to the door of said enclosure for operating said moving memos in order to move said engaging means between the positions which corresponds to the on position, the off position and the reset position of the handle of said circuit interrupter, said operating means being connected to said moving means whenever the handle of said circuit interrupter is in the on position and in the off position, and being detachable from said moving means whenever the handle of said circuit interrupter is in the reset position, said moving means including a pivot means having a pivot arm for moving said engaging means, said engaging means including an opening which is formed between at least three surfaces of said engaging means; wherein the pivot arm includes a cam surface which engages a first surface of said engaging means in order to move said engaging means from the position which corresponds to the off position to the positions which corresponds to the on position of the handle of said circuit interrupter; wherein the cam surface engages a second surface of said engaging means in order to disengage said holding means from holding said engaging means; and wherein the cam surface engages a third surface of said engaging means in order to move said engaging means from the position which corresponds to the on position to the position which corresponds to the off position, and from the position which corresponds to the off position to the position which corresponds to the reset position, and in order to resist the handle force applied to said engaging means from the position which corresponds to the reset position to the position which corresponds to the off position of the handle of said circuit interrupter.

11. The operating mechanism as recited in claim 7 wherein the handle of said circuit interrupter moves in a generally arcuate path; wherein said engaging means is a sliding means for sliding in a path which is generally tangential to the generally arcuate path of the handle of said circuit interrupter; wherein said base plate means slidably supports the sliding means; wherein the first surface of said engaging means is generally perpendicular to the path of said engaging means; wherein the second surface and the third surface are generally oblique with respect to the first surface of said engaging means; wherein the holding means is a notch in the sliding means; and wherein said base plate means includes a latch for engaging the notch of the sliding means, the third surface of said engaging means for moving the sliding means in order to engage the notch in the latch whenever said engaging means moves from the position which corresponds to the off position to the position which corresponds to the reset position of the handle, the second surface of said engaging means for moving the sliding means in order to disengage the notch from the latch whenever said engaging means moves from the position which corresponds to the reset position to the position which corresponds to the off position of the handle.

12. The operating mechanism as recited in claim 11 wherein the sliding means includes a first shoulder for moving the handle of said circuit interrupter from the off position to the on position of the handle, the first shoulder being generally parallel with the first surface of said engaging means; and wherein the sliding means also includes a second shoulder for moving the handle from the on position to the off position and from the off position to the reset position, and for resisting the handle force from the reset position to the off position of the handle, the second shoulder being at least partially oblique with respect to the first surface of said engaging means, the second shoulder being forced by the handle force in the reset position in order that the notch of the sliding means continues to engage the latch whenever said engaging means is in the position which corresponds to the reset position of the handle, and in order that the handle force is substantially decoupled by said holding means from said moving means.

* * * * *